United States Patent [19]

Matsuo et al.

[11] Patent Number: 4,917,227

[45] Date of Patent: Apr. 17, 1990

[54] CONVEYANCE SYSTEM FOR ARTICLE CONTAINER CASE

[75] Inventors: Yukito Matsuo; Tsuyoshi Ishida, both of Yokohama; Masanori Iwamoto, Tokyo; Koichiro Shin, Koshigaya; Tadatoshi Hiramatsu, Tokyo; Isao Shirai, Fujisawa, all of Japan

[73] Assignees: Kabushiki Kaisha Toshiba, Kawasaki; Nippon Shooter Co., Ltd., Tokyo, both of Japan

[21] Appl. No.: 94,707

[22] Filed: Sep. 9, 1987

[30] Foreign Application Priority Data

Sep. 11, 1986 [JP] Japan ..... 61-214600
Oct. 15, 1986 [JP] Japan ..... 61-244654

[51] Int. Cl.[4] ..... B65G 37/00

[52] U.S. Cl. ..... 198/347; 198/465.1; 198/619; 414/268; 414/285

[58] Field of Search ..... 198/347, 619, 805, 854, 198/465.1, 794, 797, 798, 801; 414/564, 266, 268, 285, 331

[56] References Cited

U.S. PATENT DOCUMENTS 3,403,799 10/1968 Sindzinski et al. ..... 414/564
3,426,887 2/1969 Ward et al. ..... 198/805 X
3,788,447 1/1974 Stephanoff ..... 198/854 X
4,615,273 10/1986 Osthus et al. ..... 198/346.1 X

FOREIGN PATENT DOCUMENTS 1047635 11/1966 United Kingdom ..... 406/2

OTHER PUBLICATIONS

"Transportation für Förderanlagen im Krankenhaus", R. Heinz, Transport und Lagertechnik, 1975, No. 3, pp. 18–19.

*Primary Examiner*—Robert J. Spar
*Assistant Examiner*—D. Glenn Dayoan
*Attorney, Agent, or Firm*—Finnegan, Henderson, Farabow, Garrett and Dunner

[57] ABSTRACT

This invention provides a three-dimensional conveyance system for automatically conveying card, chit, medicine or the like from one position to other position in a general hospital or the like. Conveyance in each of stories is carried out in accordance with a linear induction motor system which is effective for conveying article accommodated in a container case while the latter is carried on a moving body. The adjacent stories are connected to one another with the use of suitable vertical conveyance device by which container cases can be conveyed therebetween. Further, this invention provides a container case usable for the conveyance system includes a pair of guide rails and a flexible lid and by sliding the lid along the side wall surfaces of the housing of the container case, the upper open end of the container case can be opened or closed. The container case is provided with a locking mechanism in order to assure that the lid is kept in the closed state.

5 Claims, 13 Drawing Sheets

STATION I

STATION II

CONVEYANCE SYSTEM FOR ARTICLE CONTAINER CASE

BACKGROUND OF THE INVENTION

1. Field of the Invention

The present invention relates to a conveyance system for conveying from one place to another designated place various kinds of articles such as a clinical card, chit, medicine or the like, in a hospital and more particularly to the improvement of a system for conveying articles in a multi-storied building as well as a lid opening and closing mechanism for a container case in which the article is accommodated.

2. Description of the Related Art

Heretofore, when a clinical card, chart or other article is conveyed, for instance, between a medical affairs department and a medical examination room in a general hospital, conveyance is achieved with the use of various conveyance means, for instance, by using a case conveyor for the card, by using an air chuter for chit and by using a vertical conveyor for a heavy article. Further, a method of using a railway car is employed for conveying the aforesaid article with the use of same conveying means.

However, when the above-described system is employed, different kinds of plural conveying means are required and moreover provision of a plurality of these conveying means at the same location is required in order to increase the advantageous of convenience. Otherwise, it is inconvenient for personnel to walk a long distance to receive a required article. On the other hand, in the case of the above-described system it is possible to convey all articles merely with a single conveying means but a problem associated with the system is that the system is not suitable for a card, chit or the like which require need to be conveyed at high speed and to any desired place. When an air chuter is employed, it has speed but it is not suited for conveying a heavy articles. In addition, in view of the fact that a conveyance system generally moves along a curved conveyance path there is a need for installing a unit for preventing generation of noise, air sound, discharge sound or the like. Further, from the viewpoint of capacity, when a plurality of moving bodies move within a single moving section, the air chuter is not suitable.

In order to solve foregoing problems a linear induction motor at the main conveyance path may be employed. A plurality of branch paths are connected with the main conveyance path so that conveyance of article is carried out via the main conveyance path for mass conveyance. A typical linear conveyance system is shown in FIG. 18, in which an article such as medicine, a card or the like is conveyed in a container case.

However, this just-described linear conveyance system normally deals with conveyance on a single floor, and therefore a suitable arrangement by which an article can be conveyed between different stories of a building by utilizing the linear conveyance system is required.

However, since a conventional container case is constructed so that it is opened by turning two lid halves sideward, there is a need for additional space for allowing the lid halves to open sideward. This leads to the problem that at each station for delivery and arrival of article the opening through which a container case enters and leaves becomes enlarged. Particularly in the case where an automatic opening and closing mechanism is disposed for the container cases at each station, the conventional container case requires a space for opening the lid halves and therefore the container cases cannot be conveyed in side-by-side relation at the automatic opening and closing mechanism. As a result, the station itself must be designed in larger dimensions.

Therefore, the object of the present invention is to provide a conveyance system which assures that a large amount of articles such as a card, chit, medicine or the like can be conveyed at a high speed. Also, it is an object of the present invention to effectively convey such articles between different stories in a multi-storied building.

SUMMARY OF THE INVENTION

The present invention has been made with the foregoing background in minds and its object resides in providing a conveyance system which assures that a large amount of articles such as a card, chit, medicine or the like can be conveyed at a high speed. Also, it is an object of the present invention to effectively convey such articles between different stories in a multi-storied building.

To achieve the foregoing objects, and in accordance with the purposes of the invention as embodied and broadly described herein, there is provided a conveyance system for conveying an article between the stories of a building. The conveyance system comprises at least one container case for accommodating the article conveyed, a plurality of moving carriers for carrying the container case thereof, horizontal conveyance means disposed on at least one story of the building for allowing the carriers to move therealong, and a plurality of driving means disposed along the horizontal conveyance means at a predetermined interval for driving the carriers. The conveyance system further comprises a plurality of first stations provided on the horizontal conveyance means, each first station including first container case transfer means for loading the container case onto each carrier and unloading the container case from each carrier, the first container case transfer means being located at a position where one of the driving means is disposed. The first station also includes branch conveyance means for conveying the container case between the horizontal conveyance means and a case receiving and delivering portion. The conveyance system further comprises vertical conveyance means vertically extending through the stories for conveying the container case to at least one story. The vertical conveyance means comprises upper conveyance means for conveying the container case in both the upward and the downward direction to the upper stories, and lower conveyance means for conveying the container case in both and upward and the downward direction to the lower stories. The conveyance system further comprises a plurality of second stations provided on the horizontal means, each second station including second container case transfer means for loading the container case onto each carrier and unloading the container case from each carrier, the second container case transfer means being located at a position where one of the driving means is disposed. The conveyance system further comprises connecting means extending horizontally from the second container case transfer means to the vertical conveyance means so that the container case is conveyed between the vertical conveyance means and the horizontal conveyance means.

To achieve the foregoing objects, and in accordance with the purposes of the invention as embodied and broadly discussed herein there is provided.

BRIEF DESCRIPTION OF THE INVENTION

The present invention will be illustrated in the following drawings in which.

Figure 14A:
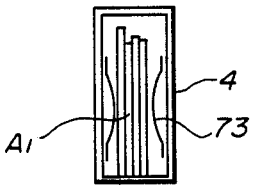
Figure 14B:
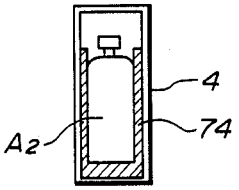

FIG. 14(*a*) and (*b*) are a cross-sectional view of the container case respectively, illustrating how different article to be conveyed are accommodated in the interior of the container case.

Figure 15:
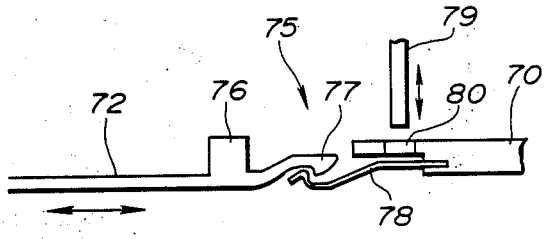

FIG. 15 is an enlarged sectional side view illustrating a locking mechanism for the container case.

Figures 16A, 16B, 16C:
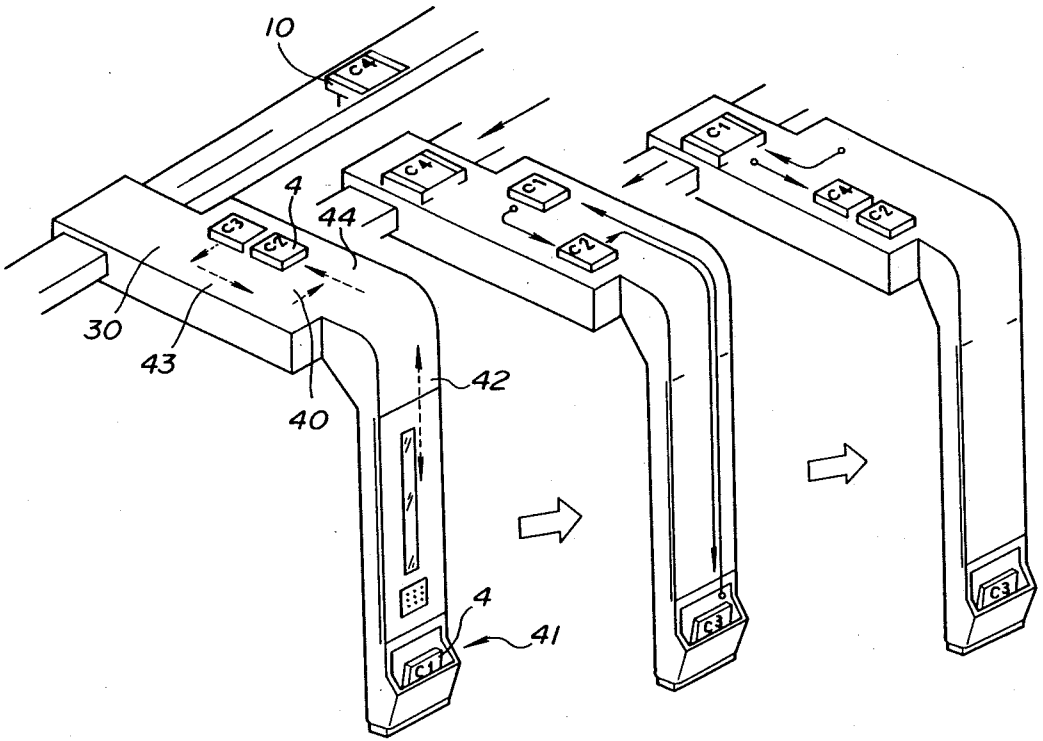

FIG. 16(*a*) to (*c*) are a perspective view of a station respectively, illustrating flow of a container cases when one of them is delivered therefrom.

Figure 18:
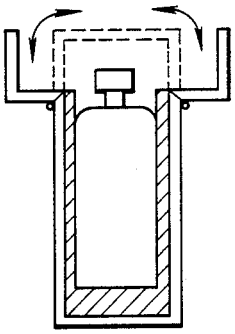
FIG.18 PRIOR ART
Figures 17A, 17B, 17C:
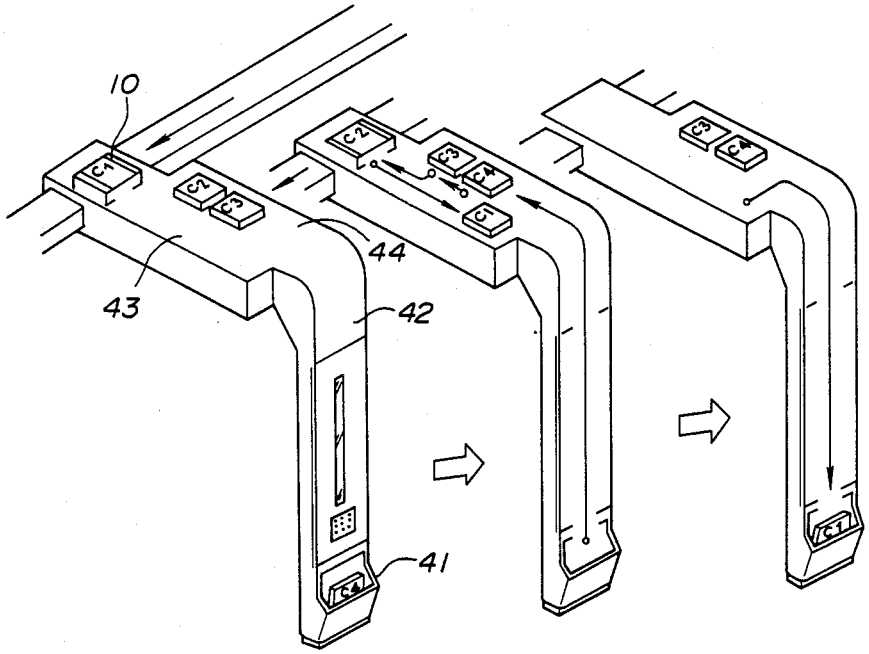

FIG. 17(*a*) to (*c*) are a perspective of the station in FIG. 16 respectively, illustrating the arrival of the container case, and FIG. 18 is a cross-sectional view of a conventional container case.

DESCRIPTION OF THE PREFERRED EMBODIMENT

Now the present invention will be described in greater detail with reference to accompanying drawings which illustrate a preferred embodiment thereof.

First of all, description will be made below to the whole structure of a conveyance system according to the present invention.

Figure 1:
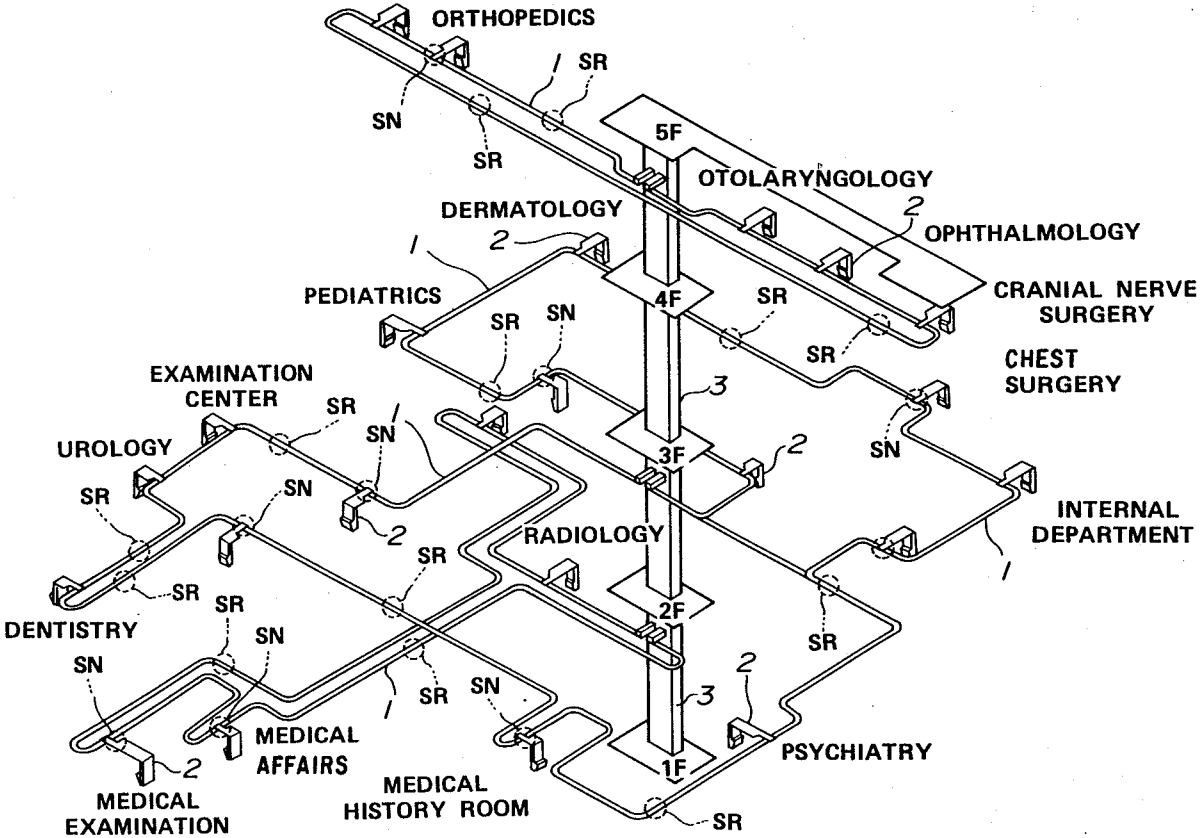
FIG. 1 is a schematic perspective view of a conveyance system in accordance with the present invention illustrating the whole arrangement of the conveyance system.

FIG. 1 schematically illustrates a conveyance system for a general hospital including main conveyance paths 1 extending from the floor of each story of the hospital. The main conveyance paths 1 include a plurality of branch conveyance paths 2 extending in the vertical direction along the inner wall of departments such as the medical affairs department, the internal department, the pediatrics department, the surgical department, the dental department, etc.

The main conveyance paths on the stories are connected to one another by means of a vertical conveyor 3 on which container cases can be conveyed to a required story.

Figure 2:
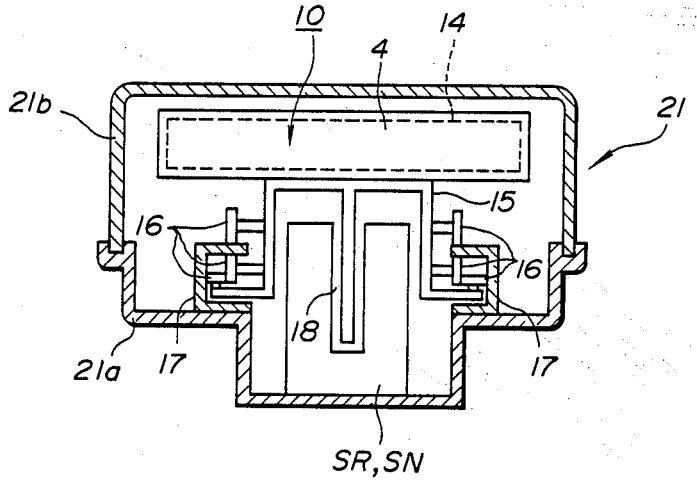
FIG. 2 is a schematic cross-sectional view of a main conveyance path illustrating its structure.
Figure 3:
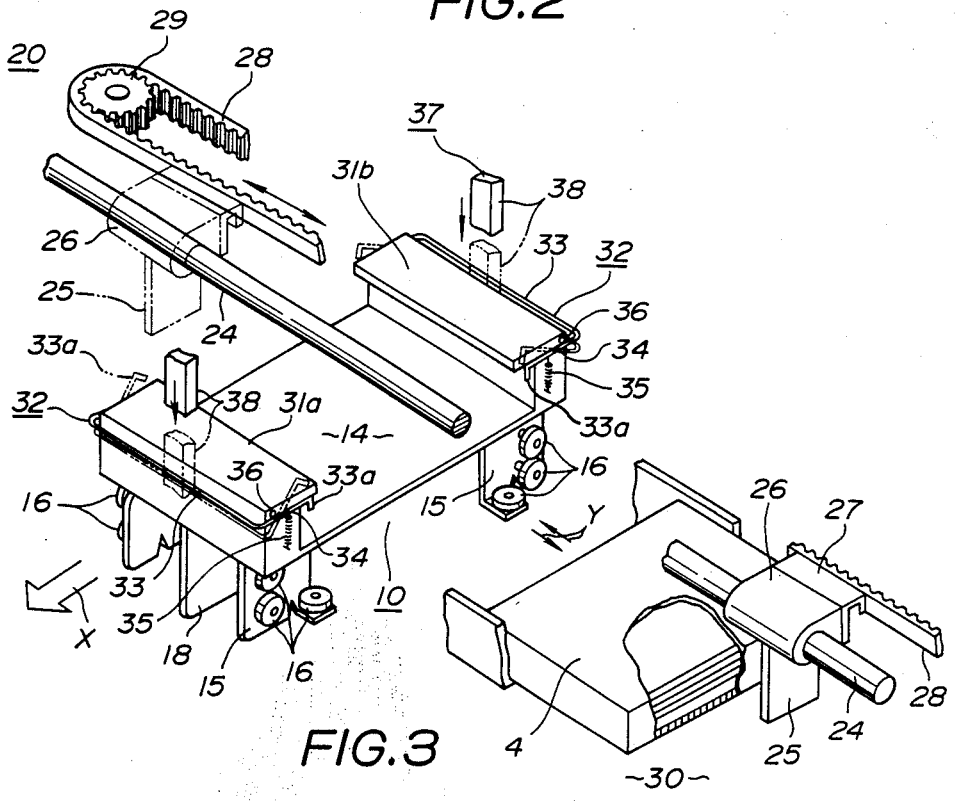
FIG. 3 is a perspective view illustrating how a container case is received and handed over between the main conveyance path and a branch conveyance path.

A number of stators SR and SN are disposed on the main conveyance path 1 a story in spaced relation at a predetermined distance to constitute a linear induction motor so that a plurality of carriers 10 (to be described later) with secondary conductors attached thereto are accelerated, decelerated, stopped or displayed under the influence of the stators SR and SN. Among the plurality of stators SR and SN, only the stators SN located at the branch position of branch conveyance paths function as a station for displaying and stopping the carrier and the other stators SR effect only acceleration and deceleration of the carrier. A container case 4 in which a variety of articles are accommodated is placed on the carrier. Specifically, as shown in FIGS. 2 and 3, the carrier 10 includes a mounting portion 14 for the container case 4 and is provided with three wheels 16 at the four corners thereof by means of which it is free to move on guide rails 17 of the main conveyance path 1. Conveyance of the carrier 10 is achieved by means of a linear induction motor which consists of a conductor 18 on the carrier 10 and a primary conductor comprising the plurality of stators SR and SN disposed at a predetermined distance on the main conveyance path 1. Namely, as the stators SR and SN are turned on by activating a power source device which is not shown in the drawings, magnetic flux which varies as time elapses is applied to the secondary conductor 18, causing a certain intensity of propulsive or reverse propulsive force to be generated on the secondary conductor 18, whereby the carrier 10 is displaced or stopped. Reference numeral 2 designates a casing for covering the main conveyance path 1 which comprises a lower case 21*a* and an upper case 21*b* removably attached to the lower case 21*a* in order to assure that inspection and maintenance are performed easily.

As mentioned above, the stators SN for the linear motor are disposed at the position where the branch conveyance path 2 of the main conveyance path 1 is located so as to allow the carrier 10 to be stopped or displaced as required and as shown in FIG. 3. A case displacement mechanism indicated generally at 20 is disposed at the aforesaid position for the purpose of receiving and handing over the container case 4 between the main conveyance path 1 and the branch conveyance path 2.

A guide shaft 24 extends at a right angle relative to the direction of movement on the main conveyance path 1 for the carrier 10 as identified by X arrow mark and a movable member 26 with a thrust plate 25 attached thereto is slidably mounted on the guide shaft 24. Further, a timing belt 28 with a connecting member 27 attached thereto is connected to the movable member 26 spans a pair of pulleys 29 (only one of them being shown) located in the vicinity of both the ends of the guide shaft 24. One of the pulley 29 is driven by a pulse motor (not shown) via a train of speed reduction gears which are not shown in the drawings so that the movable plate 26 is reciprocably displaced in the direction of arrows X.

The height of the thrust plate 25 is so determined that the side face of the container case 4 is thrusted thereby and by reciprocable movement of the thrust plate 25 the container case 4 held in the carrier 10 is pushed out on a loading/unloading portion 30 (see FIG. 4) of the branch conveyance path 2 or the conveyance case 4 located on the loading/unloading portion 30 is placed on the carrier 10. The carrier 10 is so designed that the container case 4 is held within the spaced as defined by generally inverted L-shaped holding frame portions 31*a* and 31*b*. Thus, movement of the case 4 mounted on mounting portion is limited in the forward and rearward direction along the direction of the carrier 10 and the case 4 is free to move in the placement direction (Y direction). Accordingly, the holding frame portions 31*a* and 31*b* are provided with a pair of case fixing means 32 for the purpose of inhibiting the case held on the mounting portion 14 from be thrown away during conveyance of the case 4. The case fixing means 32 is constructed as shown in FIG. 3. The fixing member 33 which is producted in such a manner that both the ends of a wire are bent in the same direction and moreover their foremost ends are bent downwardly and operatively mounted on the holding frame portions 31*a* and 31*b* to turn about support shafts 34. A spring 35 serving as urging member is secured to each of both the ends of the fixing member 33. The spring 35 is urged to the position where the fixing member 33 abuts against a stopper 36, that is, the position where the foremost ends 33*a* of the fixing member 33 are projected downwardly of the upper surface of the holding frame portions 31*a* and 31*b*. Thus, the case 4 placed on the mounting portion 14 is immovably held by four foremost ends 33*a* of the fixing member 33 as shown in the drawing.

On the other hand, releasing the means 37 for releasing the fixing action of the case fixing means 32 as required is provided on the station side. The releasing means 37 is so constructed that a pair of depressing rods 38 are lowered by cylinders (not shown) to abut against the middle part of the fixing members 33 to turn downwardly against resilient force of the springs 35. Thus, turning movement of the fixing member 33, their foremost ends 33*a* are displaced to the position where inserting and removal of the case 4 are not inhibited, as shown by the dotted lines in FIG. 3.

Figure 4:
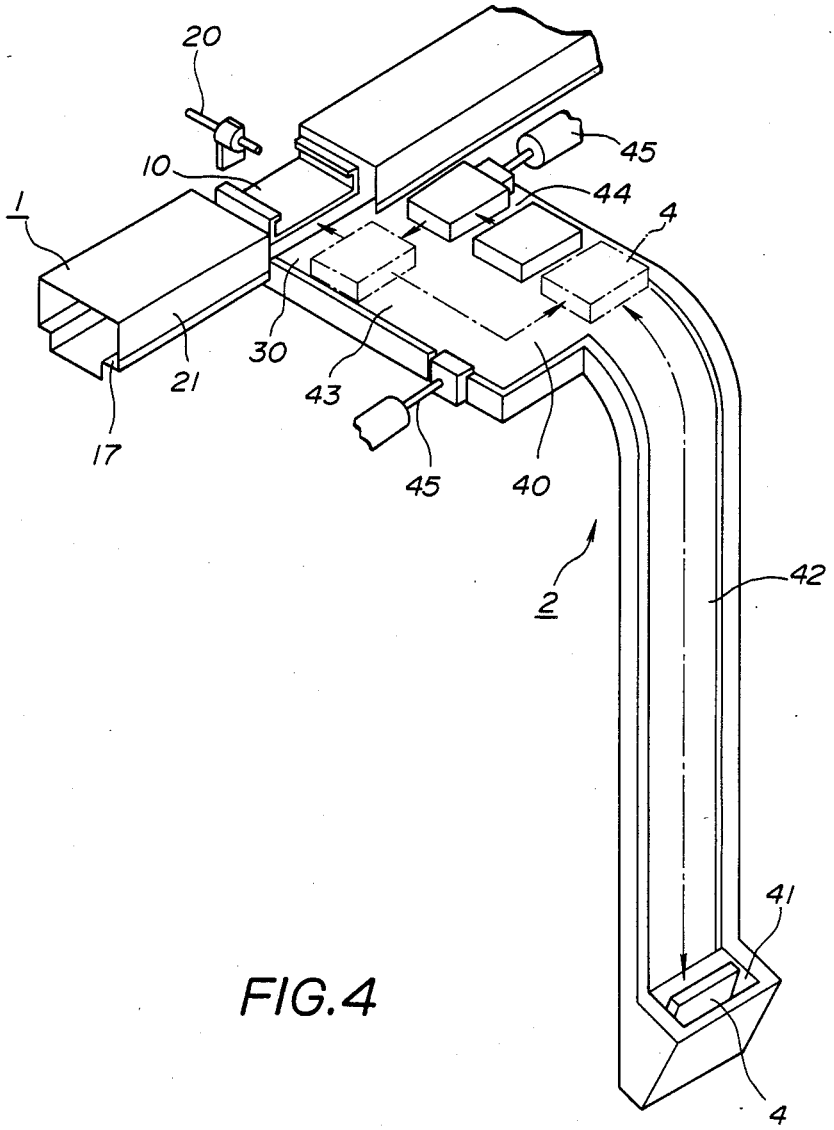
FIG. 4 is a perspective view of the branch conveyance path illustrating how container cases are conveyed thereon.
Figure 5:
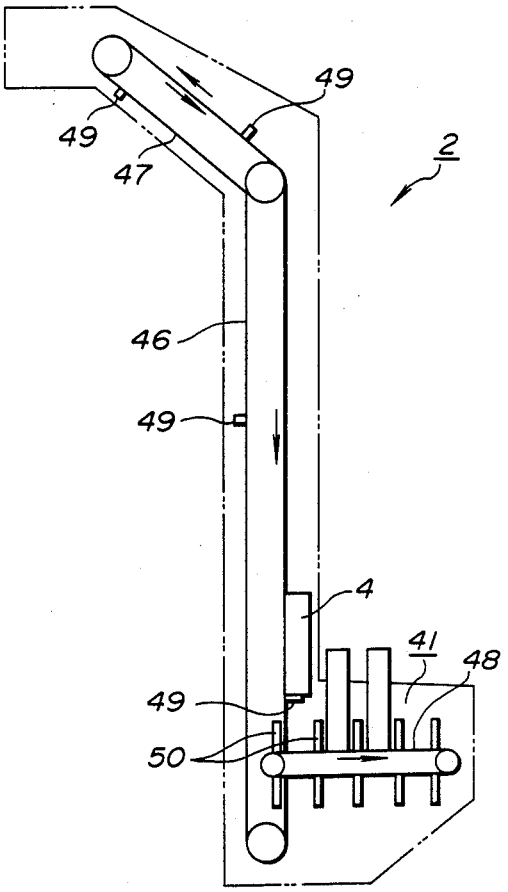
FIG. 5 is a schematic side view illustrating an example of the structure of the branch conveyance path.

As shown in FIG. 4, the branch conveyance path comprises a loading/unloading portion 30 located opposite to the position wherein the carrier 10 stops its movement, a stage portion 40 where the three container cases 4 placed on the loading/unloading portion 30 can be arranged in two lines and a vertical reciprocable conveyance portion 42 for vertically conveying cases 4 between the stage portion 40 and the case receiving and delivering portion 41. Further, in the stage portion 40 reference number 43 designates a receiving conveyance portion for conveying the case 4 from the carrier 10 to the receiving side and reference numeral 44 designates a hand-over conveyance portion for conveying the case 4 to the carrier 10. A thrust mechanism 45 is disposed at the lower end of the receiving conveyance portion 43 and the upper end portion of the hand-over conveyance portion 44. By actuating the thrust mechanism 45, the case 4 is moved at a right angle on the stage portion 40 as represented by a dotted line.

In the branch conveyance path 2 as mentioned above, a mechanism for conveying cases 4 comprises a first vertically extending conveyance belt 46 with a plurality of pawls 49 secured thereto, a second conveyance belt 47 with a plurality of pawls 49 secured thereto operatively connected to the upper end of the first conveyance belt 46 and a transversely extending conveyance belt 46 at a right angle relative to the latter. The cases 4 are conveyed while they are supported by the pawls 49. It should be noted that the transverse conveyance belt 48 is provided with a plurality of backup members 50 in spaced relation which move a distance equal to one pitch every time one case 4 is received. Thus, the cases 4 are displaced while standing in an upright state.

Figure 6:
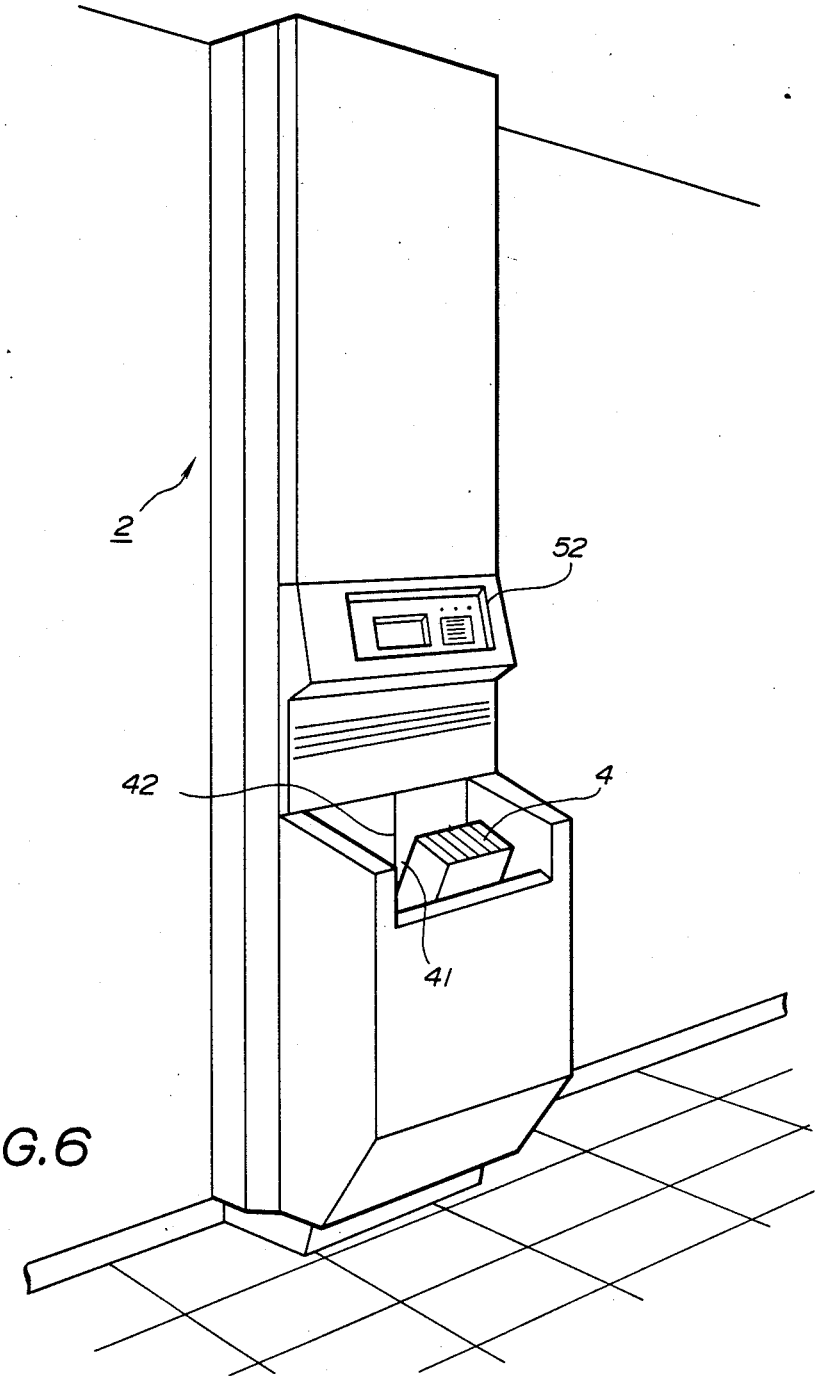
FIG. 6 is a perspective view illustrating the configuration of a station.

FIG. 6 is a perspective view of a branch conveyance path 2, that is, a delivery and arrival station installed on a floor of, for instance, the medical affairs department on the first story. Case 4, having a lid on the upper part thereof which has been conveyed through the main conveyance path 1 and the branch conveyance path 2, is shown at a case receiving/hand-over portion 41. The fact of the arrival of the case is displayed on a control panel 52. A sound representing the arrival is generated from a chime or the like which is not shown in the drawing. Further, the branch conveyance path 2 is equipped with an opening and closing detector (not shown) for detecting the opening or closing of the case 4 at the time of delivery thereof. When the destination of the case 4 is designated by the control panel 52, it is detected by the opening and closing detector whether the lid is closed or not and when the lid is closed correctly, the case 4 is conveyed upwardly by actuating the vertical conveyance portion 42.

Figure 7:
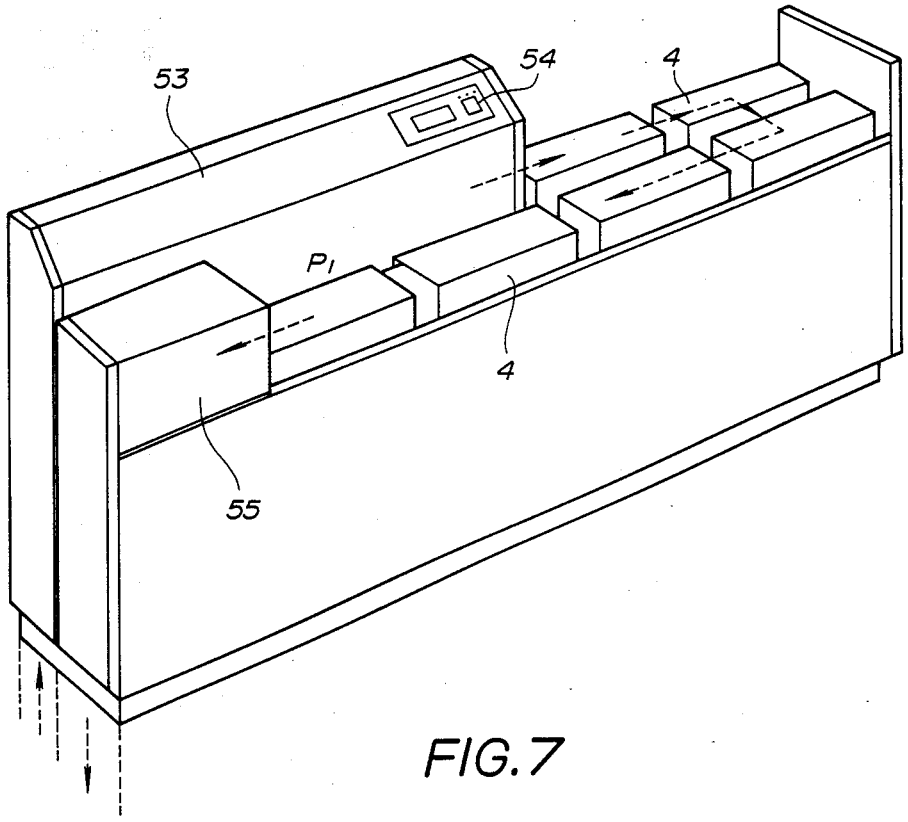
FIG. 7 is a perspective view illustrating the configuration of another station.

FIG. 7 illustrates by way of a perspective view another delivery and arrival station installed on a floor of, for instance, a card room. A case 4 which has arrived includes a lid which is automatically opened by means of a lid opening mechanism 53. Detecting means (not shown) detect whether an article is existent in the case 4 or not. At this moment the case 4 with no article contained therein is subjected to sterilization with the use of an ultraviolet ray type sterilization unit (not shown). Incidentially, the case 4 having an article contained therein is not sterilized in order to avoid any influence on the article. On arrival of the case 4 the fact of arrival is displayed on a control panel 54 and is indicated by a sound generated by, for instance, a chime or the like. The cases with their lids opened are successively arranged one after another in the delivery and arrival station of FIG. 7.

When case 4 having an article contained therein is delivered, the case 4 is placed on position $P_1$ and thereafter a destination determination button and a deliver button on the control panel 54 are depressed, causing the case 4 to be displaced toward a lid closing mechanism 55 incorporated in the station. Consequently, the Lid is automatically closed by the lid closing mechanism 55 and the case 4 is then delivered to the main conveyance path 1 via the branch conveyance path 2. Incidentially, all the cases 4 located before the position $P_1$ include a lid which is opened so that subsequent to the above-mentioned determinations and insertion of other kinds of articles into the cases can be achieved.

Figure 8:
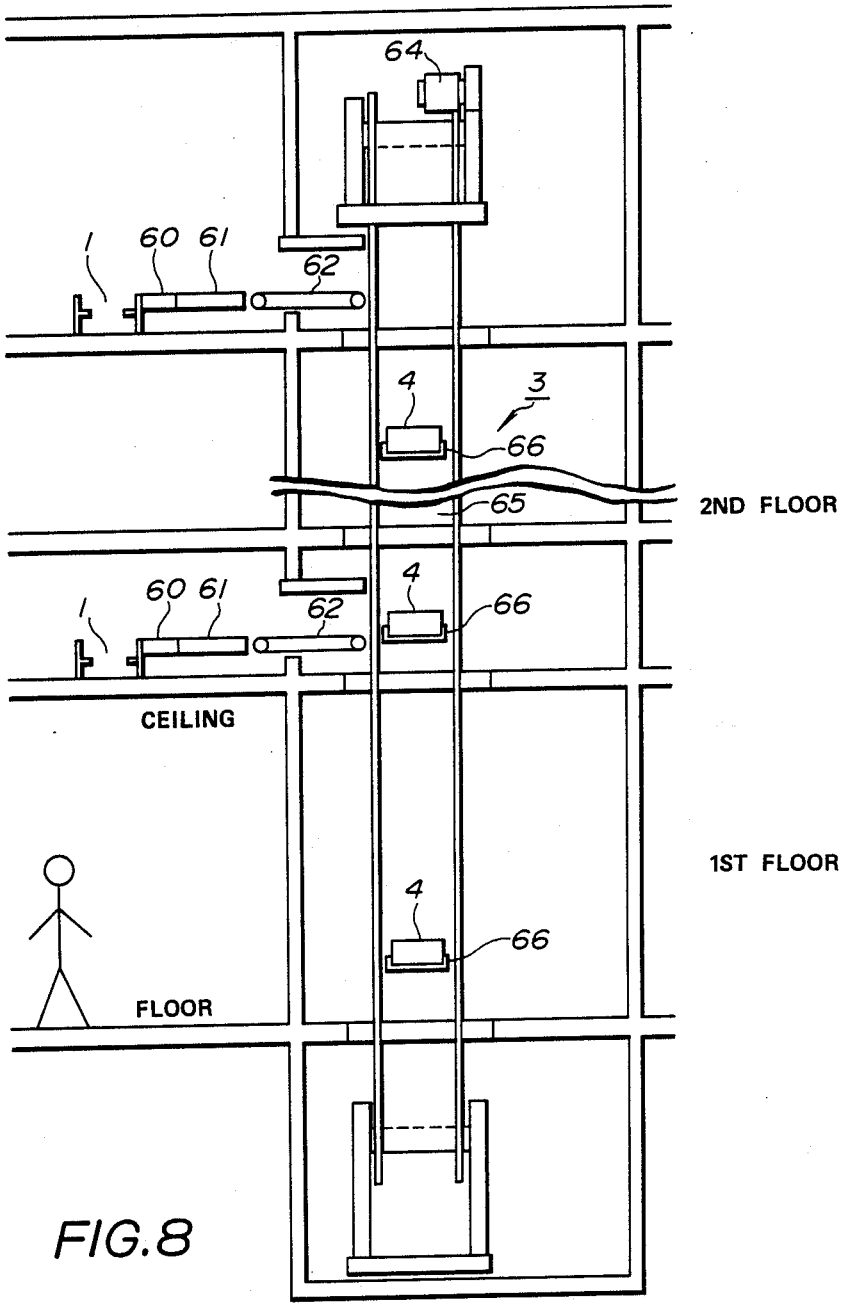
FIG. 8 is a schematic side view of a multi-storied building, particularly illustrating a vertical conveyance path.
Figure 9:
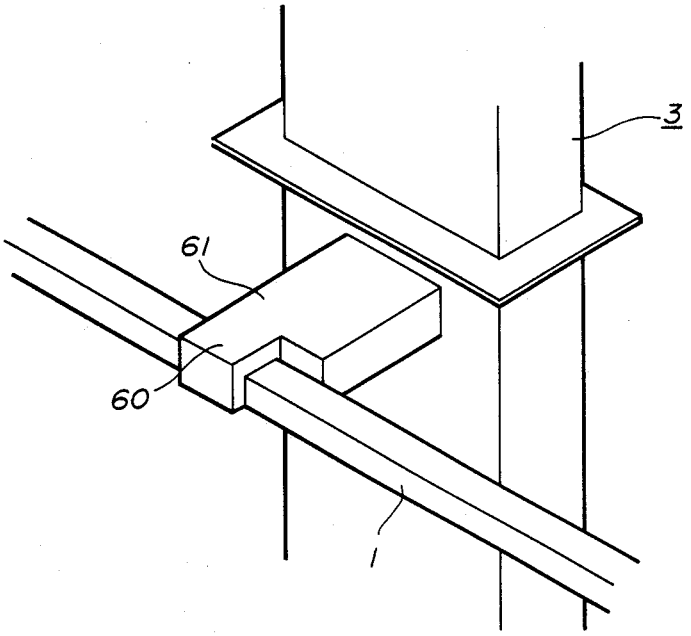
FIG. 9 is a fragmental perspective view of the vertical conveyance path in FIG. 8.

FIG. 8 illustrates a schematic structure of a vertical conveyor through which container cases are vertically conveyed. FIG. 9 illustrates the outer configuration of the vertical conveyor and FIG. 10 illustrates the inner structure of the vertical conveyor.

Figure 10:
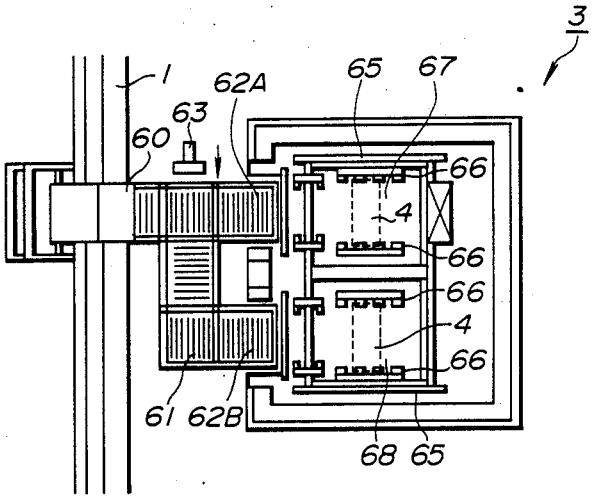
FIG. 10 is a cross-sectional view of the vertical conveyance path in FIG. 8.
Figure 11:
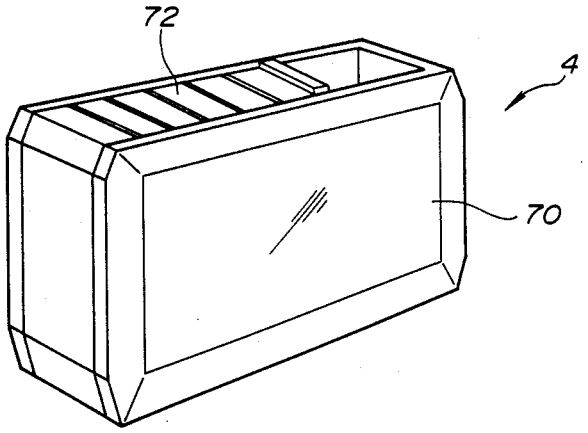
FIG. 11 is a perspective view illustrating the configuration of a container case.
Figure 12:
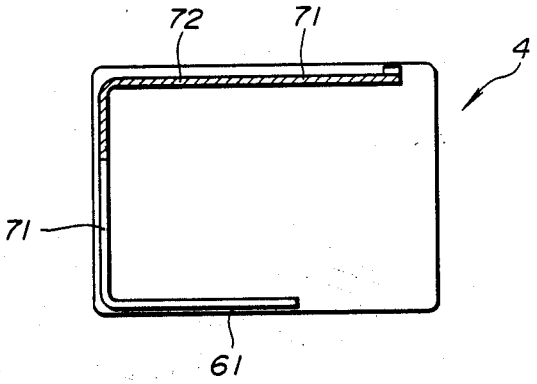
FIG. 12 is a vertical sectional view of the container case in FIG. 11.
Figure 13:
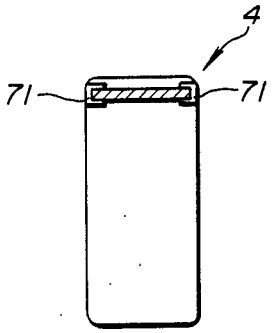
FIG. 13 is a cross-sectional view of the container case in FIG. 11.

Referring to FIGS. 8 to 10, main conveyance path 1 and vertical conveyor 3 are connected to one another via a horizontal path transfer portion 60, a buffer portion 61 and a vertical path transfer portion 62. With respect to the horizontal path transfer portion 60, loading and unloading of a container case 4 are carried out between the horizontal path transfer portion 60 and the carrier 10 is held immovable on the main conveyance path 1 the structure of which is shown, for instance, in FIG. 3. With respect to the buffer portion 61, buffering of the container cases 4 to be conveyed and changeover of the conveyance path are achieved by means of thrust mechanism 63. With respect to the vertical path transfer portion 62, loading and unloading of the container case 4 are carried out between the vertical path transfer portion 62 and the vertical conveyor 3.

The vertical conveyor 3 is designed in the form of a wound belt mechanism which is driven by an electric motor 64 and includes a belt 65 to which a plurality of vertical conveyance members 66 are secured for the purpose of supporting the container cases 4 and conveying them. An upward conveyance portion 67 and a downward conveyance portion 68 are shown in FIG. 10. Since the conveyance belt 65 is driven in one direction, an upward conveyance portion 67 in the belt mechanism is normally conveyed upwardly and a downward conveyance portion 68 is normally conveyed downwardly.

Incidentally, as shown in FIG. 10, the vertical path transfer portion 62 includes an upward transfer portion 62A for carrying out loading and unloading of the cases relative to the upward conveyance portion 67 and a downward transfer portion 62B for carrying out loading and unloading of the cases relative to the downward conveyance portion 68.

Next, description will be made below as to the container case 4 usable for the conveyance system with reference to FIGS. 11 to 15.

The container case 4 includes a box-shaped case housing 70 of which upper surface is opened, a pair of substantially U-shaped guide rails 71 on the upper end, the side end and lower end of the housing and a flexible lid 72 disposed slidably along the guide rails 71. Thus, the lid 72 is opened and closed along the wall surface of the case housing 70 by sliding along the guide rails 71.

The configuration of the case 4 is the same irrespective of the kind of article to be conveyed but the interior of the case 4 is configured corresponding to article to be accommodated therein. For instance, in the case where article $A_1$ to be conveyed is card, chit or the like, a pair of leaf springs 73 are disposed in a juxtaposed relation in the case 4 as shown in FIG. 14(*a*). In this case, the article $A_1$ is clamped between the leaf springs 73 whereby vibratory movement of the article can be prevented and drawing-out and inserting can be achieved easily. On the other hand, in the case where article $A_2$ to be conveyed is a bottle or the like, a separate inner case 74 is fitted between the case 4 and the article $A_2$ as shown in FIG. 14(*b*). Thus, any rattling movement of the bottle can be prevented.

Further, the container case 4 is provided with a locking mechanism 75 as shown in FIG. 15. Specifically, the lid 72 is formed with a grip 76 for opening and closing and a pawl 77 and the case housing 70 is provided with a resilient tongue 78 made of spring material. When the lid 72 is closed, the pawl 77 is engaged with the resilient tongue 78 so that the lid is kept in the locked state.

The grip 76 in the form of a raised member is aligned with the displacement member of an automatic lid opening and closing mechanism (not shown) mounted on each of delivery and receiving stations. Thus, by engaging the displacement member with the grip, the lid 72 can be opened automatically.

As is apparent from FIG. 15, the container case 4 has a hold 80 through which the displacement member 79 of an unlocking mechanism on each of the delivery and receiving stations extends. By depressing the resilient tongue 78 downwardly by the displacement member 79 which has moved through the hole 80, the resilient tongue 78 is disengaged from the pawl 77 whereby the locked state is released.

When the container case constructed as shown in FIG. 15 is used, the lid 72 is opened and closed merely by sliding along the wall surface of the case housing 70. Consequently, there is no need for excessive space other than the container case housing when the lid is opened and closed.

As embodied herein, the lid is designed in a flexible structure. Alternatively, the lid may be constructed by employing flexible material. Further as embodied herein, the guide rails are secured to the upper end, the side end and the lower end of the container case may be omitted in dependence on dimensions of the container case. Further, the grip 76 is designed in compliance with the shape of a displacement member of the automatic cover opening and closing mechanism. Accordingly, the grip 76 should not be limited only to the raised member in the above-described embodiment but it may be designed in the form of recessed member, ring-shaped member or the like.

Next, description will be made below of the conveyance of the container cases 4 in accordance with the above-mentioned embodiment with reference to FIGS. 16 and 17 in addition to the foregoing drawings.

For instance, an article A may be conveyed from the medical affairs department on the floor of the first story to an ophthalmology department on the floor of the fourth story shown in FIG. 1. FIGS. 16(*a*) to (*c*) illustrate conveyance in Station I in the medical affairs department serving as delivery side, and FIGS. 17(*a*) to (*c*) illustrate conveyance in Station II in the ophthalmology department serving as the receiving side.

The Station I previously assumes an initial state in which three cases $C_1$, $C_2$, and $C_3$ are arranged as shown in FIG. 16(*a*). When an operator designates destination and delivery source and pushes a delivery button after the article A to be conveyed is accommodated in the empty case $C_1$ at a case receiving and delivering portion 41, control of the conveyance article is effected with the aid of a control system (not shown) so that an empty carrier 10 is located at the shortest distance to Station I is caused to move and stop at Station I. Moreover, control is effected for the purpose of loading the case in Station I prior to conveyance of the case in which the article is accommodated. First, in Station I empty cases $C_2$ and $C_3$ located at the hand-over conveyance portion 44 of the stage 40 are successively displaced to the receiving conveyance portion 43 and thereafter the delivery of case $C_1$ at the case receiving and delivering portion 41 is conveyed to the uppermost end position of the hand-over conveyance portion 44. Further, the empty cases $C_2$ and $C_3$ at the receiving conveyance portion 43 are successively conveyed to the position as shown in FIG. 16(*b*) and they wait there until the carrier 10 arrives. When the carrier 10 with an empty case $C_4$ carried thereon arrives at Station I shown in FIG. 16(*b*), the case $C_4$ is unloaded on the loading and unloading portion 30 and thereafter the case $C_4$ is displaced to the position behind the empty case $C_2$ as shown in FIG. 16(*c*).

Next, the case $C_1$ which has been located at the position shown in FIG. 16(*b*) is loaded on the carrier 10 via the loading and unloading portion 30. This carrier 10 is caused to move immediately by activating the stator and it stops its movement after it moves to the vertical conveyor 3 on the same story. In response to this the horizontal path transfer portion 60 disposed between the first story and the second story is driven so that the case $C_1$ on the carrier 10 is unloaded and an empty case is then loaded on the carrier 10. The case $C_1$ unloaded on the horizontal path transfer portion 60 is displaced to the buffer portion 61 and then it waits on the upward transfer portion 62A. Then, by actuation of the upward transfer portion 62A, the case $C_1$ is placed on an empty vertical conveyance member 66 when it moved by the side of the upward transfer portion 62A. The vertical conveyance member 66 with the case $C_1$ carried thereon is once displaced to the uppermost story by operating the belt mechanism and it is then lowered to a required floor during downward movement. When the vertical conveyance member 66 arrives at the downward transfer portion 62B below the floor of the fifth story, the case $C_1$ is unloaded from the vertical conveyance member 66 by means of the downward transfer portion 62B. The case $C_1$ loaded on the downward transfer portion 62B between the fourth story and the fifth story is displaced via the buffer portion 61 and then stops its movement at the horizontal path transfer portion 60. The horizontal path transfer portion 60 waits until arrival of the carrier 10 and the case $C_1$ is loaded on the carrier 10 immediately after arrival thereof. Then, the carrier 10 moved on the main conveyance path 1 located between the fourth floor and the fifth floor and stops at Station II on the floor of the destination of the ophthalmology department. When the carrier 10 with the case $C_1$ carried thereon arrives, an initial state of arrangement of three empty cases $C_2$, $C_3$ and $C_3$ in Station II is as shown in FIG. 17(*a*). First, the case $C_1$ is unloaded from the carrier 10 and then displaced to the end part of the receiving transfer portion 43 as shown in FIG. 17(*b*). Next, the empty case $C_2$ is loaded on the carrier 10 and empty cases $C_3$ and $C_4$ are displaced to the upper end part of the hand-over conveyance portion 44 as shown in FIG. 17(*b*). Thereafter, the case $C_1$ is conveyed to the case receiving the hand-over portion 41. The arrival of the case $C_1$ is indicated by display means, a chime sound or the like.

As is apparent from description of the foregoing embodiment, upward conveyance and downward conveyance between horizontal conveyance systems with the use of a plurality of linear motors on each story are achieved by a single line of vertical conveyors. Moreover, the horizontal conveyance system and the vertical conveyor are driven independently. Consequently, a large amount of articles can be conveyed between a plurality of stories at a high efficiency as well as at a high speed. Further, since vertical conveyance in the vertical conveyor 3 is carried out by means of cases 4 but not by means of carriers 10, receiving and handing-over of article between the main conveyance paths 1 and vertical conveyor 3 and construction required for achieving vertical conveyance can be simplified with light weight. Furthermore, since the conveyance system is provided with buffer portions 61 which assures that a plurality of cases 4 are arranged for the purpose of buffering between the main conveyance paths 1 and the vertical conveyor 3, receiving and handing-over of the cases can be carried out smoothly and effectively.

It should of course be understood that the present invention can be changed or modified in a suitable manner without departure from the scope of invention and particularly the structure of the vertical conveyor should not be limited only to the illustrated embodiment but any other type of vertical conveyance mechanism may be employed.

We claim:

1. A conveyance system for conveying an article between the stories of a building comprising:

at least one container case for accommodating the article conveyed;

a plurality of moving carriers for carrying a container case thereon;

horizontal conveyance means disposed on at least one story of the building for allowing said carriers to move therealong;

a plurality of driving means disposed along the horizontal conveyance means at a predetermined interval for driving the carriers;

a plurality of first stations provided on the horizontal conveyance means, each first station including first container case transfer means for loading the container case onto each carrier and unloading the container case from each carrier, said first container case transfer means being located at a position where one of the driving means is disposed, each first station further including branch conveyance means for conveying the container case between the horizontal conveyance means and a case receiving and delivering portion;

vertical conveyance means vertically extending through the stories for conveying the container case to at least one other story, said vertical conveyance means comprising upper conveyance means for conveying the container case in both the upward and downward direction to the upper stories, and lower conveyance means for conveying the container case in both the upward and downward direction to the lower stories;

a plurality of second stations provided on the horizontal conveyance means, each second station including second container case transfer means for loading the container case onto each carrier and unloading the container case from each carrier, said second container case transfer means being located at a position where one of the driving means is disposed; and connecting means extending horizontally from the second container case transfer means to the vertical conveyance means so that the container case is conveyed between the vertical conveyance means and the horizontal conveyance means.

2. The conveyance system of claim 1 wherein said connecting means includes a buffer portion at which a plurality of container cases are held for the purpose of buffering.

3. The conveyance system of claim 1 wherein said vertical conveyance means includes an electric motor, a belt mechanism driven by said motor, wherein the belt mechanism includes a driving shaft adapted to be driven by the motor, driven shafts driven by the driving shaft, a belt driven by the driven shafts, and a plurality of case supporting members secured to said belt for supportably conveying the container case, further wherein said belt mechanism is driven in one direction so that it includes an upward conveyance portion for upwardly conveying the container case and a downward conveyance portion for downwardly conveying the container case.

4. A conveyance system for conveying an article between the stories of a building comprising:

at least one container case for accommodating the article conveyed;

a plurality of moving carriers for carrying a container case thereon;

horizontal conveyance means disposed on at least one story of the building for allowing said carriers to move therealong;

a plurality of driving means disposed along the horizontal conveyance means at a predetermined interval for driving the carriers;

a plurality of first stations provided on the horizontal conveyance means, each first station including first container case transfer means for loading the container case onto each carrier and unloading the container case from each carrier, said first container case transfer means being located at a position where one of the driving means is disposed, each first station further including branch conveyance means for conveying the container case between the horizontal conveyance means and a case receiving and delivering portion;

vertical conveyance means vertically extending through the stories for conveying the container case to at least one other story, said vertical conveyance means comprising upper conveyance means for conveying the container case in both the upward and the downward direction to the upper stories, and lower conveyance means for conveying the container case in both the upward and the downward direction to the lower stories;

a plurality of second stations provided on the horizontal means, each of the second stations including second container case transfer means for loading the container case onto each carrier and unloading the container case from each carrier, said second container case transfer means being located at a position where one of the driving means is disposed; and connecting means extending horizontally from the second container case transfer means to the vertical conveyance means so that the container case is conveyed between the vertical conveyance means and the horizontal conveyance means, said connecting means comprising a first connecting conveyance means extending from the second container case transfer means and a plurality of second connecting conveyance means, one of the second connecting conveyance means extending from the upper conveyance means and another of the second connecting conveyance means extending from the lower conveyance means, said connecting means further comprising switching means for switching the direction of movement of the container case, said plurality of second connecting conveyance means being connected to said first connecting conveyance means via said switching means, said switching means switching between a first path formed by said first connecting conveyance means and one of said second connecting conveyance means, and a second path formed by said first connecting conveyance means and said another of second connecting conveyance means.

5. The conveyance system of claim 4 wherein vertical conveyance means includes an electric motor, a belt mechanism driven by said motor, wherein the belt mechanism includes a driving shaft adapted to be driven by the motor, driven shafts driven by the driving shaft, a belt driven by the driven shafts, and a plurality of case supporting members secured to said belt for supportably conveying the container case, further wherein said belt mechanism is driven in one direction so that it includes an upward conveyance portion for upwardly conveying the container case and a downward conveyance portion for downwardly conveying the container case.

* * * * *